US005322002A

United States Patent [19]

Miskelly, Jr. et al.

[11] Patent Number: 5,322,002

[45] Date of Patent: Jun. 21, 1994

[54] TUBE LAUNCHED WEAPON SYSTEM

[75] Inventors: Herman L. Miskelly, Jr., Huntsville; Richard L. Alldredge, Arab, both of Ala.

[73] Assignee: Thiokol Corporation, Ogden, Utah

[21] Appl. No.: 56,426

[22] Filed: Apr. 30, 1993

[51] Int. Cl.[5] ..... F41F 1/00

[52] U.S. Cl. ..... 89/8; 89/1.7; 89/1.704; 89/1.816

[58] Field of Search ..... 89/7, 8, 1.7, 1.703, 89/1.704, 1.705, 1.816, 1.818, 1.813, 1.814

[56] References Cited

U.S. PATENT DOCUMENTS

| | | | |
|---|---|---|---|
| 200,740 | 2/1878 | Lyman | 89/8 |
| 484,011 | 10/1892 | Haskell | 89/8 |
| 1,380,358 | 6/1921 | Cooke | 89/1.703 |
| 2,360,217 | 10/1944 | Francis | 89/8 |
| 2,397,800 | 4/1946 | Arthur | 89/8 |
| 3,129,636 | 4/1964 | Strickland et al. | 89/1.703 |
| 3,610,093 | 10/1971 | Mebus | 89/1.704 |
| 3,814,694 | 6/1974 | Klager et al. | 252/186 |
| 3,857,321 | 12/1974 | Cohen | 89/1.81 |
| 3,947,300 | 3/1976 | Passauer et al. | 149/35 |
| 4,073,213 | 2/1978 | Stauff | 89/1.701 |
| 4,157,054 | 6/1979 | Cobb | 89/8 |
| 4,590,842 | 5/1986 | Goldstein et al. | 89/8 |
| 5,033,355 | 7/1991 | Goldstein et al. | 89/8 |
| 5,053,087 | 10/1991 | Flanagan et al. | 149/19.8 |

*Primary Examiner*—David H. Brown

*Attorney, Agent, or Firm*—Madson & Metcalf

[57] ABSTRACT

A tube launched rocket system which uses a plurality of small propellant charges located within the tube to propel the rocket. The charges form part of the outer wall of a traveling propulsion chamber. The rest of the chamber is substantially defined by a propulsion housing, which includes a forward plate that abuts the projectile, and an aft nozzle for venting gases from the interior of the chamber. Alternative embodiments also contain baffles for directing the flow of combustion gases, and may employ an electronic ignition system for igniting the propellant charges in sequence. As charges adjoining the propulsion chamber are ignited, the resulting combustion gases thrust into the interior of the chamber, forcing the housing forward as they flow aftward through the nozzle. As the propulsion housing travels through the tube, additional propellant charges are ignited as they effectively become part of the outer wall of the propulsion chamber. The housing pushes the projectile ahead of it through the tube. Use of a sequence of small propellant charges in the tube rather than a conventional rocket motor in the projectile makes the system's noise level manageable, permits the use of nontoxic propellant compositions, and eliminates the risk that a user will be burned by rocket motor exhaust as the projectile exits the tube. The teachings of the present invention also apply to closed breech systems.

19 Claims, 5 Drawing Sheets

TUBE LAUNCHED WEAPON SYSTEM

BACKGROUND

1. The Field of the Invention

The present invention relates to a tube launched rocket system which includes a plurality of small propellant charges located within the tube which propel the rocket by thrusting gases into a travelling propulsion chamber. More particularly, the present invention relates to a tube launched rocket system which uses relatively non-toxic propellant and produces manageable levels of noise.

2. Technical Background

One staple of modern military operations is the tube launched weapon system such as conventional anti-aircraft and anti-tank weaponry. These systems generally involve the firing of a projectile which utilizes a rocket motor for propulsion. The rocket propelled projectile is launched from an open tube. As a result, these devices are classified as open breech devices, as opposed to rifles, howitzers and the like which launch a projectile from a tube having one closed end.

Tube launched weapon systems are very important in modern military operations. A foot soldier using these systems can deliver much larger quantities of explosive force than was possible using conventional closed breech infantry weapons. For example, anti-tank and anti-aircraft missiles can be launched using a tube system supported by a man's shoulder. Because the aft end of the tube is open, recoil from the rocket motor is manageable, and there is no need to construct massive recoil absorption systems such as those found on a howitzer.

Tube launched weapon systems face several significant design problems. For example, in previously disclosed systems the projectile launched by the system includes a rocket motor for propulsion. It is critical that the motor completely burn out before it leaves the tube; if the rocket motor is still burning when it exits the tube, the hot exhaust may severely injure the system's user. Thus, the propellant in the rocket motor must burn extremely rapidly but still provide maximal forward thrust.

In addition, the propellant must be designed to perform properly under a wide range of ambient conditions. For example, it is preferable that the propellant function equally well at sea level and at high altitudes, in extreme heat and extreme cold, in jungle humidity and in arid desert air. It will be appreciated, however, that designing the propellant to burn out before exit under such extreme conditions results in a rocket motor that provides less than optimal performance under most circumstances.

Another serious concern is the noise produced by operation of the system. Since the propellant must be consumed while the projectile is in the launch tube, it must burn with almost explosive force. In addition, many conventional devices of this type include a plug in the throat of the rocket motor. The ignition of the rocket motor must produce enough force to immediately dislodge the plug. The required pressure is generally in the range of 50 to 150 psi. In typical devices of this type the rise time, or time of pressurization, is in the range of about 5 to 10 milliseconds. Within 50 milliseconds, the projectile has exited the tube. Creating the require pressure within the permitted time results in a significant pressure wave following burn out of the rocket motor.

Ignition and launch of the rocket motor therefore produce a very large sound wave. Indeed, the sound wave is large enough that it presents a significant safety concern. The sound wave itself has the potential of causing injury or death to the user. Accordingly, it is now conventional for the user to wear ear plugs, ear muffs, and a helmet.

The pressure and sound waves caused by the launch of tube launched rocket motors are such that it is not possible to safely operate the device within a building. Such operation may damage the building and endanger the occupants of the building. This limitation is significant in that there are often situations where use of such devices within a building would be desirable.

Another problem encountered in the use of this type of device is the relative toxicity of the propellant. Conventional propellants used in devices of this type contain significant levels of lead and/or copper. Therefore, repeated use of the device by a single soldier, as during practice exercises, poses a health risk.

Thus, it would be an advancement in the art to provide a tube launched weapon system capable of imparting adequate forward thrust to a projectile through the use of relatively non-toxic propellant.

It would also be an advancement in the art to provide a high-performance tube launched weapon system that produces manageable levels of noise.

It would be a further advancement in the art to provide a tube launched weapon system in which the requirement of protecting users from rocket motor exhaust burns was not a significant constraint on propellant composition.

It would also be an advancement in the art to provide a tube launched weapon system configured to facilitate user adjustments in the amount of propellant employed.

Such an apparatus is disclosed and claimed herein.

BRIEF SUMMARY AND OBJECTS OF THE INVENTION

The present invention comprises a tube launched weapon system employing a propulsion housing which travels through the tube directly behind the projectile being launched. The propulsion housing is not powered by a rocket motor contained in the projectile, as in conventional prior disclosures. Rather, the projectile is accelerated by a sequence of relatively small propellant charges disposed along the interior of the tube. The charges form part of the outer wall of a propulsion chamber. The rest of the chamber is defined by a propulsion housing. The housing includes a forward plate, which abuts the projectile, and an aft nozzle for venting gases from the interior of the chamber. The forward plate and the nozzle are secured to one another by a restraining member having slots. In some embodiments, the housing may contain one or more baffles for directing the flow of gases.

An initial ignition of one charge starts the propulsion housing moving through the tube, because the rapidly expanding gases produced by the ignition flow into the chamber defined by the charges and the housing. The increased gas pressure on the forward plate pushes the projectile ahead as gases vent out the nozzle. As the propulsion housing travels through the tube, additional propellant charges are ignited as they become aligned with the housing. That is, the charges ignite as they effectively become part of the outer wall of the propulsion chamber.

In a presently preferred embodiment, the system includes an electronic ignition system having a power supply, a controller, and a wire electrically connecting the charges to the power supply for appropriate ignition under the controller's direction. Each propellant charge is relatively small, but ignition of the charges in proper sequence provides adequate thrust to the propulsion housing and hence to the projectile.

Advantageously, each charge being relatively small permits the use of charges composed of relatively non-toxic materials, such as metal azide compositions, without unacceptable sacrifices in projectile range. Moreover, smaller charges fired in sequence result in a stair-stepping increase in pressure over time. Because pressure increases cause significant noise, the gradual pressure increase created by the present invention is preferable to the single large increase over a very short time caused by previously disclosed systems based on rocket motors located in the projectile.

An additional advantage is inherent in the use of charges disposed along the interior of the tube rather than attached to the projectile. There is no risk of burns to the user from a projectile's rocket motor back blast because the projectile contains no rocket motor. Projectile burn out under a wide range of environmental conditions is no longer a design constraint, because the projectile never burns—all ignitions occur inside the tube.

Although the present disclosure focuses on tube launched weapon systems, it will be appreciated that closed breech devices may also benefit from the present invention of a travelling fixed size propulsion chamber powered by charges attached to the barrel. Use of charges attached to a barrel closed at one end to accelerate a projectile through the barrel toward the open end is known in the art. But the propulsion chamber in these prior disclosures is effectively formed by the charges, the walls of the barrel, the closed end of the barrel, and the aft end of the projectile. Since the aft end of the projectile and the closed end of the barrel are clearly not connected, the propulsion chamber grows in volume as the projectile moves through the barrel. To obtain the same acceleration it therefore becomes necessary to use increasingly powerful charges as the chamber grows in volume. In the present invention, however, the propulsion chamber has a fixed size. Thus, one need not employ successively more powerful propulsion charges as the projectile moves.

It is a primary object of the present invention to provide a tube launched weapon system in which the requirement of protecting users from rocket motor exhaust burns is not a significant constraint on propellant composition.

It is a related object of the invention to provide a high-performance tube launched weapon system that produces manageable levels of noise.

It is also an object of the present invention to provide a tube launched weapon system capable of imparting adequate forward thrust to a projectile through the use of relatively non-toxic propellant.

It is a further object of the invention to provide a tube launched weapon system configured to facilitate user adjustments in the amount of propellant employed.

These and other objects and advantages of the invention will become apparent upon reading the following detailed description and appended claims, and upon reference to the accompanying drawings.

BRIEF DESCRIPTION OF THE DRAWINGS

To illustrate the manner in which the advantages and objects of the invention are obtained, a more particular description of the invention will be rendered by reference to specific embodiments which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention can be best understood by reference to the drawings where like parts are designated with like numerals throughout. One embodiment of the apparatus of the present invention is generally designated 10 in FIG. 1.

Figure 1:
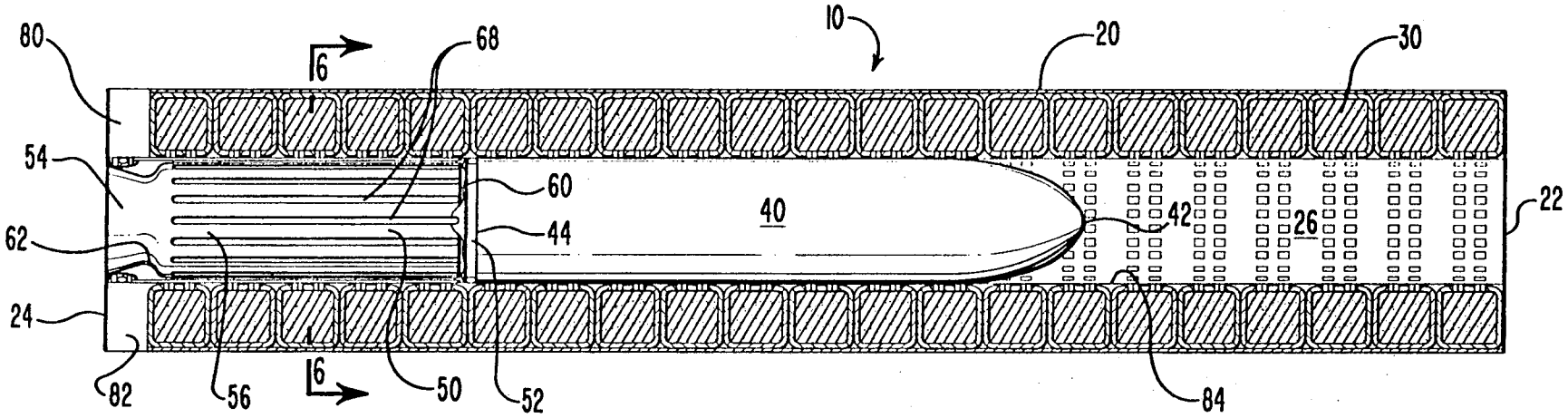
FIG. 1 shows a longitudinal cross sectional view of the interior of one embodiment of the tube of the present invention. A propulsion housing and projectile are shown positioned in the tube prior to ignition.

FIG. 1 shows a tube 20 in longitudinal cross section. A plurality of propellant charges 30 are located along the interior 26 of the tube 20. In a presently preferred embodiment, the charges 30 are toroidal in shape, and are placed along the interior of the tube 20 so as to form a tubular structure having an open interior 26.

Figure 6:
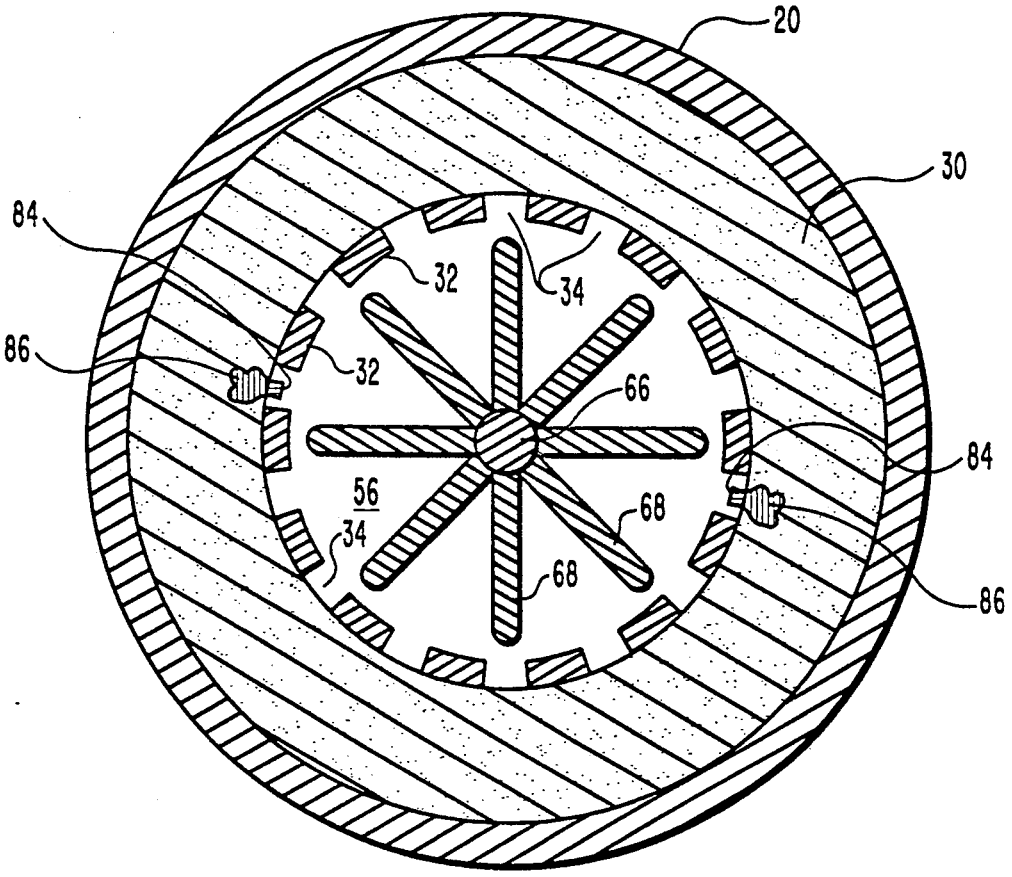
FIG. 6 is a transverse cross sectional view taken along line 6—6 of FIG. 1.

FIG. 1 shows a complete projectile 40 and propulsion housing 50 in the tube 20 at their initial position before ignition. In this initial position, the aft end 54 of the propulsion housing 50 is near the aft end 24 of the tube 20. The forward end 52 of the propulsion housing 50 abuts the aft end 44 of the projectile 40, and the forward end 42 of the projectile points toward the forward end 22 of the tube 20. A restraining member with attached baffles 68 connects the forward plate 60 and the nozzle 62. FIG. 6 shows the restraining member 66 and baffles 68 of the FIG. 1 embodiment in cross section. The alternative embodiment of the propulsion housing illustrated in FIG. 7 has no baffles but employs as a restraining member a cylindrical housing 53 having slots 58.

With reference once more to FIG. 1, the portion of the interior 26 of the charges 30 which lies between the forward plate 60 and the nozzle 62 of the propulsion housing 50 forms the interior 56 of the propulsion housing 50. Thus, the charges 30, the nozzle 62, the restraining member, and the forward plate 60 define a propulsion chamber whose volume remains substantially constant as the projectile 40 travels through the tube 20.

Figure 5:
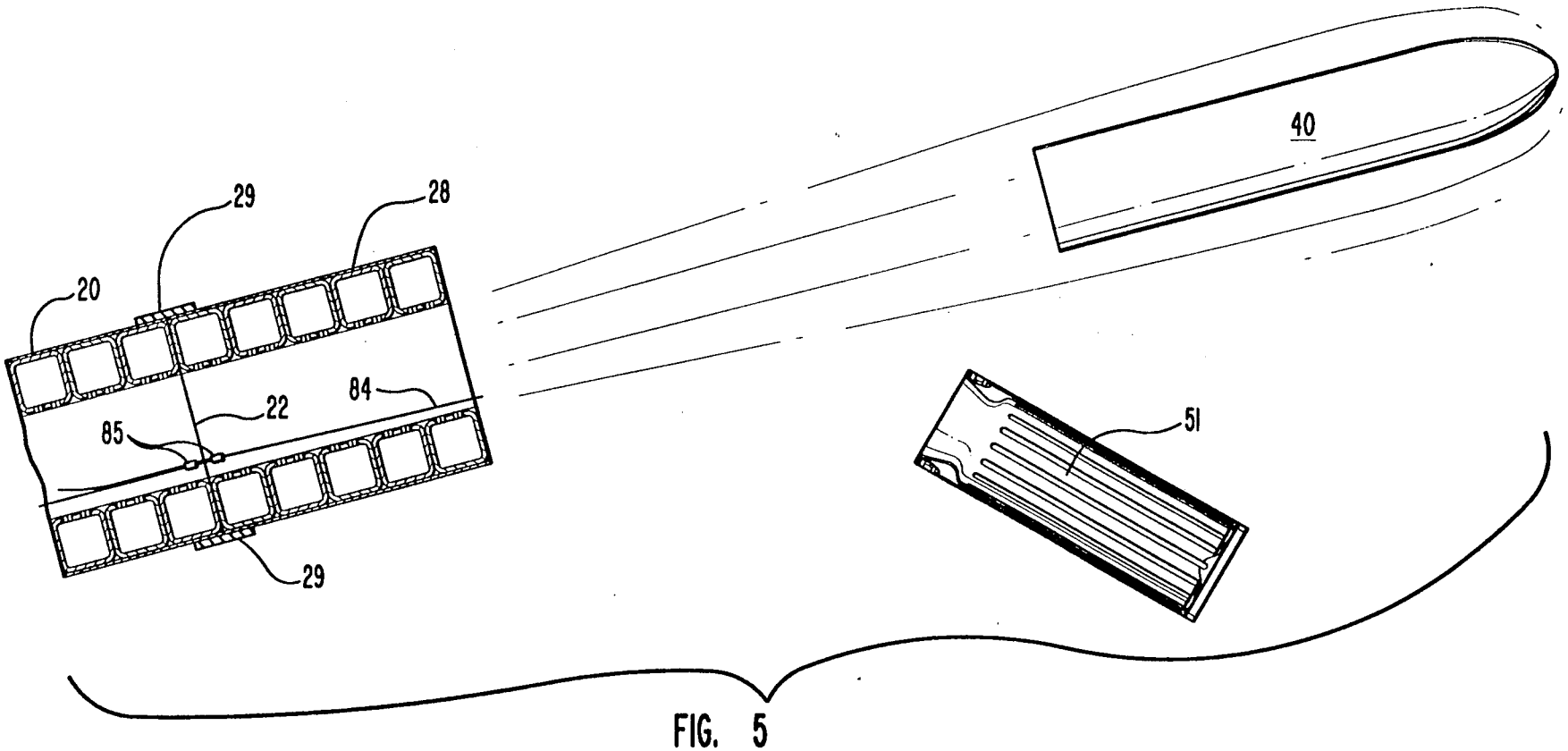
FIG. 5 shows an embodiment of the present invention in which the projectile and the propulsion housing separate after emerging from a tube. The tube depicted has been extended by the addition of a second tube.

In an alternative embodiment, shown in FIG. 5, tubes of equal diameters but varying lengths may be attached to one another in end-to-end fashion, thereby providing users with control over the total number of charges employed to launch a given projectile. Thus, users may conserve munitions by utilizing tubes having fewer charges when lesser projectile ranges are adequate, and utilizing longer tubes having more charges only when greater projectile ranges are required. An extension tube 28 has been attached to the forward end 22 of the original tube 20. An extension tube attachment apparatus 29 physically secures the extension tube 28 to the original tube 20. Wire connectors 85 serve to extend the electronic ignition system.

In the embodiment shown in FIG. 1, an electronic ignition system is used to ignite the charges 30 and propel the projectile 40 out the forward end 22 of the tube 20. The electronic ignition system comprises an electrical power supply 80, an ignition controller 82, and a wire 84. The wire 84 is shown in FIG. 6, as well as in FIG. 1. As indicated in FIG. 6, embodiments employing propellant charges 30 which are not directly ignitable electronically may also comprise an igniter 86. Various igniters, such as $BKNO_3$, are known in the art.

Reference is now made to FIGS. 1 and 6. Upon receipt of a command from the user, the ignition controller 82 releases electrical energy through the wire 84 into the igniters 86 in sequence, thereby igniting the charges 30 in sequence. Gases released by the combusting charges 30 propel the projectile 40 through the tube 20 in a fashion described below.

Figure 2:
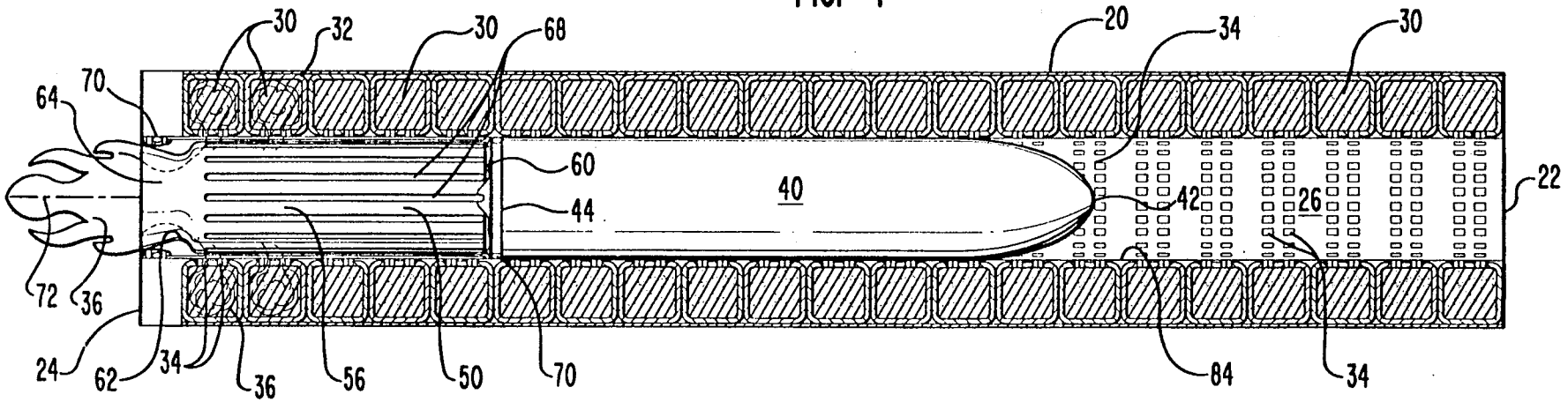
FIG. 2 shows the apparatus of FIG. 1 immediately after ignition of the first two propellant charges.

As shown by FIG. 2, the charges are preferably ignited in sequence, beginning with charges adjacent to the interior 56 of the propulsion housing 50 at the aft end 24 of the tube 20. Rapidly expanding gases 36 created by igniting the charges flow into the interior 56 of the propulsion housing 50. In the embodiment of FIGS. 1 and 2, each charge 30 is surrounded by a charge casing 32 having ports 34 that direct the gases 36 inward toward the central longitudinal axis 72 of the propulsion housing 50. The gases 36 thus are directed into a propulsion chamber defined essentially by the charges 30, the forward plate 60 of the propulsion housing 50, and the nozzle 62 of the propulsion housing 50. Seals 70 may be employed at the ends of the propulsion housing 50 to reduce leakage of the gases 36. Since there is a throat 64 in the nozzle 62 but no corresponding opening in the forward plate 60, the gases 36 pass aftward through the nozzle throat 64 and drive the propulsion housing 50 forward, according to the action-reaction principle of physics. The forward plate of the propulsion housing 50 abuts the aft end 44 of the projectile 40, so the gases 36 driving the housing 50 likewise drive the projectile 40 forward.

Figure 7:
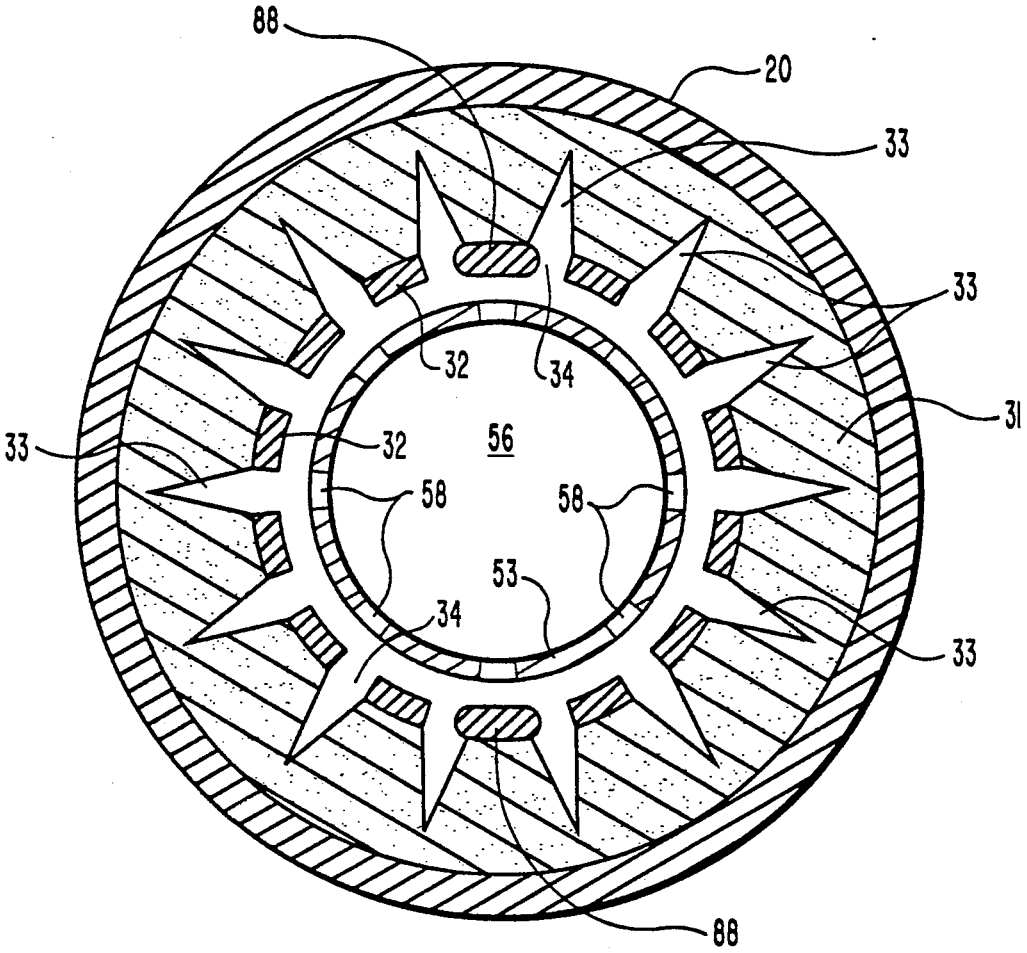
FIG. 7 is a transverse cross sectional view of an alternative embodiment, in which the interior of the propulsion chamber is star-shaped by virtue of grooves in the propulsion charge, and the propulsion housing employs slots with no baffles.

As the propulsion housing 50 moves forward, additional charges become sequentially adjacent to the interior 56 of the propulsion housing 50. These charges are in turn ignited by activation of the igniter by electrical power sent from the power supply through the wire 84 by the ignition controller. Alternatively, the charges may be ignited in response to a signal from a proximity sensor 88, as depicted in FIG. 7. The proximity sensor ignites the charge 31 directly, or via an igniter, in response to the proximity of the propulsion housing to the charge 31. Referring once more to FIG. 2, the combustion products produced once the charge 30 is ignited flow into the propulsion chamber, where they press against the forward plate 60, adding to the forward impetus of the projectile 40, and also flow aftward through the throat 64 in the nozzle 62.

Advantageously, these exhaust gases may be relatively non-toxic. Because the present invention employs a sequence of smaller propellant charges instead of a rocket motor, the charges may be composed of less explosive yet less toxic materials. One such material is a composition of metal azide, such as sodium azide, which is known in the art.

Figure 3:
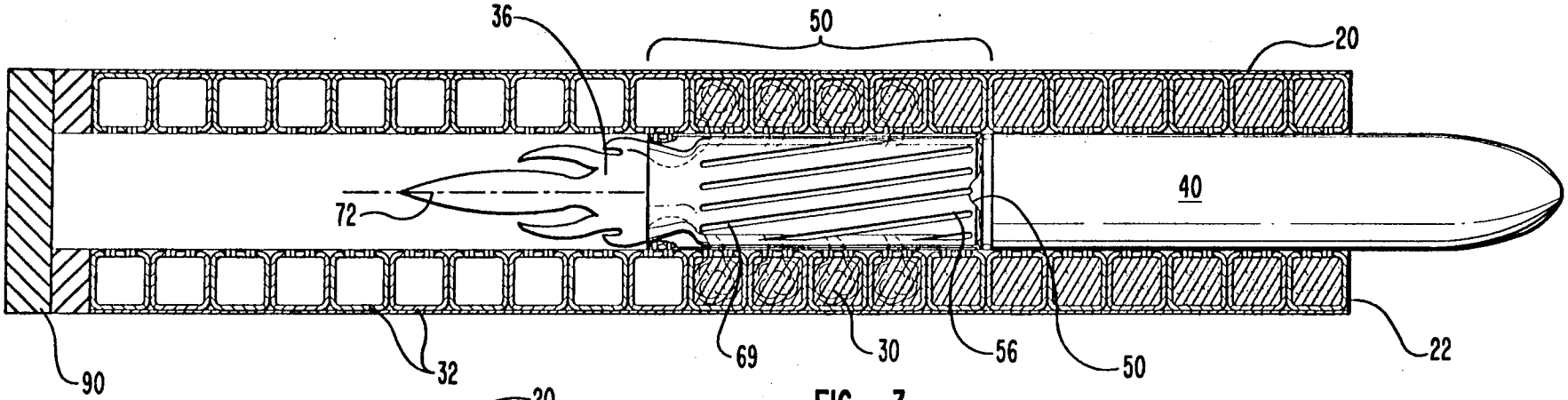
FIG. 3 shows an alternative embodiment of the apparatus of the present invention employing helical baffles and a breech closure. The propulsion housing and projectile are shown positioned in the tube after a number of propulsion charges have ignited.

FIG. 3 shows an alternative embodiment which is similar to the apparatus of Figures I and 2 but employs baffles 69 arranged helically about the central longitudinal axis 72 of the propulsion housing 50. The housing 50 and projectile 40 are shown in their positions after a number of the propellant charges 30 have been ignited and expended substantially all of the resulting rapidly expanding gases. These burned out propellant charges are indicated by substantially empty charge casings 32, although some particulates or other residue may remain in the casing after burn out. Other charges 30, being aligned with the propulsion housing 50, are still expelling gases 36 into the propulsion chamber in the interior 56 of the propulsion housing 50. Charges near the front end 22 of the tube 20 have not yet been ignited because they are not yet aligned with the propulsion housing 50.

As indicated by the breech 90, the teachings of the present invention apply to closed breech systems as well as open breech devices. In particular, closed breech devices may employ sequentially ignited charges along the interior of a tube to propel a fixed-size propulsion chamber through the tube. Closed breech devices may thereby obtain the reduced noise levels and other advantages of the present invention. Closed breech devices employing the present invention would include recoil management systems and other necessary components known in the art.

Figure 4:
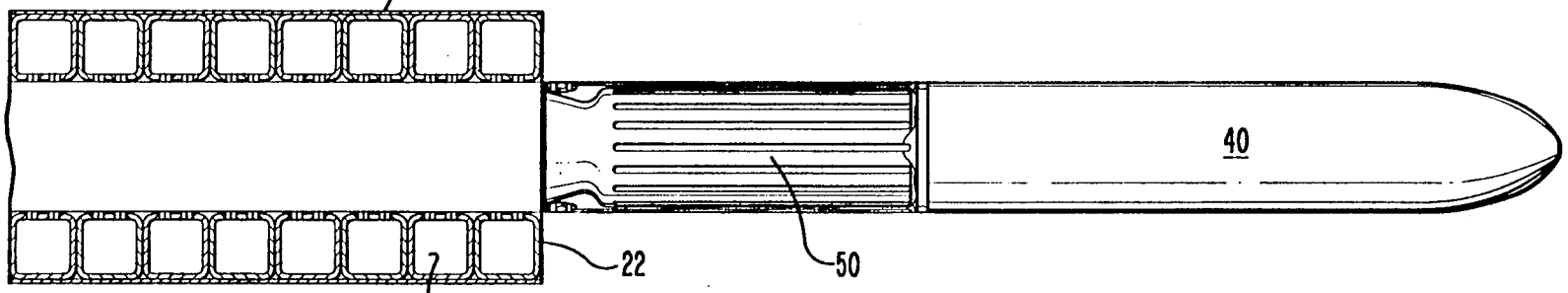
FIG. 4 shows the apparatus of FIG. 1 after all charges have burned out and the projectile has emerged from the tube.

FIG. 4 shows the projectile 40 and propulsion housing 50 of FIGS. 1 and 2 immediately after they exit the forward end 22 of the tube 20. All the charges 30 have been ignited. Advantageously, there is no danger of rocket motor exhaust burn to the user at this time, as there may be in a conventional tube launched weapon, because the charges 30 are contained inside the tube 20 rather than in the projectile 40. The projectile 40 itself does not emit exhaust gases when launched.

Additionally, since a sequence of smaller charges is employed, the pressure wave produced by the charges grows relatively slowly in comparison to the pressure waves of conventional tube launched weapon rocket motor systems. Thus, the noise produced by the present invention is more manageable than in previous systems.

In a presently preferred embodiment of the present invention, the propulsion housing is secured to the projectile, so the projectile and housing fly together toward the intended target. However, in an alternative embodiment illustrated in FIG. 5, the propulsion housing 51 separates from the projectile 40 and drops to the ground some distance beyond the forward end 22 of the tube 20, while the projectile continues on toward the target. The embodiment of FIG. 5 provides increased range for the projectile by decreasing the mass in flight by detaching the propulsion housing Care must be taken, however, to ensure that the separation of the propulsion housing 51 from the projectile 40 does not alter the projectile's intended flight path.

FIG. 6 shows a transverse cross sectional view, taken along the line 6—6 of FIG. 1. The tube 20 is circular in cross section, and the charges 30 are toroidal. The charges 30 form a tubular structure having an open interior. The portion of the interior of the charge structure which lies between the forward plate and the nozzle of the propulsion housing forms the interior 56 of the propulsion housing. The charge 30 is enclosed within a charge casing 32 provided with ports 34, so that when the charge 30 is ignited, the resulting rapidly expanding gases are directed toward the interior 56 of the propulsion housing. Planar baffles 68 direct the expanding gases toward the forward and aft ends of the propulsion housing.

It is known in the art that the gas pressure developed from combustion of a propellant increases as a function of the combusting surface area. One method of increasing the combustible surface area of the present invention would be to lengthen the propulsion housing; another would be to increase the inside diameter of the toroidal charges which form part of the outer wall of the propulsion chamber. The alternative embodiment shown in FIG. 7 illustrates a third possibility. The charges 31 forming the wall of the propulsion chamber have grooves 33 such that the interior 56 of the propulsion chamber is star-shaped. The grooves 33 provide greater charge surface area, and thereby provide a greater combustible surface area. Thus, the grooves provide a greater volume of combustion gases per unit of time after ignition of the charge 31 than the embodiment of FIG. 6.

As shown in FIG. 6, a restraining member 66 may be employed to secure the nozzle of the propulsion housing to the forward plate. An alternative embodiment of the restraining member including a cylinder 53 having slots 58 is shown in FIG. 7. In either embodiment, the charges, the nozzle, and the forward plate define a propulsion chamber whose volume remains substantially constant as the projectile travels through the tube. Advantageously, this constant volume permits the same acceleration to be imparted by charges of equal explosive power located at different points along the tube. In previously disclosed systems employing charges attached to a gun barrel, by contrast, the propulsion chamber increases in volume as the projectile moves, so that gas compressibility decreases the effective force of later ignited charges as compared to earlier ignited charges.

In summary, the present invention provides a tube launched weapon system in which the requirement of protecting users from rocket motor exhaust burns is not a significant constraint on propellant composition. Because the propellant charges lie within the tube rather than being attached to the projectile, there is no danger that exhaust from an exiting projectile will burn the user. Propellants can therefore be chosen to maximize their performance in a wide range of environments without increasing the risk to users.

Moreover, the invention provides a high-performance tube launched weapon system that produces manageable levels of noise. By employing a sequence of small charges rather than a single large charge, the present invention creates a pressure wave that increases in steps over time. The pressure wave of conventional systems, by contrast, rises rapidly to its peak over a very short time, and therefore produces pressure waves that severely restrict the circumstances in which conventional systems may safely be used.

Additionally, the present invention provides a tube launched weapon system capable of imparting adequate forward thrust to a projectile through the use of a relatively non-toxic propellant. Each charge can be composed of metal azides or other compositions not commonly used in conventional rocket motors, because the charges act in sequence over time. Additional charges may also be added in a modular fashion. Thus, users may conserve munitions by utilizing tubes having fewer charges when lesser projectile ranges are adequate, and utilizing longer tubes having more charges only when greater projectile ranges are required.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for accelerating a projectile in a tube, the projectile having a forward and an aft end, the tube having a forward end, an aft end, and an interior, the apparatus comprising:

a plurality of propellant charges disposed along the interior of the tube and configured such that when ignited, combustion products from the charges enter the interior of the tube;

means for igniting the propellant charges in sequence, commencing with a charge near the aft end of the tube and proceeding with successive charges approaching the forward end of the tube; and a propulsion housing located at the aft end of the projectile and movable within the tube, the housing having a forward end, an aft end having an opening, and an interior located between the forward end and the aft end, the interior being in fluid communication with at least one of the charges, such that when the propellant charges are ignited while adjacent to the propulsion housing, combustion gases from the charges flow into the interior of the propulsion housing and out the opening of the aft end.

2. The apparatus of claim 1, wherein the propellant charges are generally toroidal in shape.

3. The apparatus of claim 1, wherein a portion of at least one propellant charge has a groove adjacent to the interior of the tube for providing a larger combustible surface area for producing a larger volume of combustion gases upon ignition of the charge.

4. The apparatus of claim 1, wherein the propellant charges are substantially non-toxic.

5. The apparatus of claim 1, wherein the propellant charges comprise a metal azide.

6. The apparatus of claim 1, further comprising a charge casing located between at least one of the propellant charges and the interior of the tube, the casing having a port permitting fluid communication between the charge and the interior of the tube.

7. The apparatus of claim 1, wherein the means for igniting the propellant charges in sequence comprises a plurality of proximity sensors, each of the propellant charges adjoining at least one proximity sensor, such that propellant charges are ignited in sequence in response to proximity of the propulsion housing to the charge as the propulsion housing moves through the tube.

8. The apparatus of claim 1, wherein the means for igniting the propellant charges in sequence comprises a plurality of igniters, each propellant charge adjoining at least one of the igniters, for igniting the propellant charges.

9. The apparatus of claim 1, wherein the propulsion housing is secured to the aft end of the projectile.

10. The apparatus of claim 1, further comprising a seal located near the forward end of the propulsion housing between the propulsion housing and a propellant charge for reducing fluid communication between the interior of the propulsion housing and the interior of the tube forward of the propulsion housing.

11. The apparatus of claim 1, further comprising an extension mechanism for extending the length of the tube by attaching a second tube, the second tube having a forward end, an aft end, an interior, and at least one propellant charge disposed in the interior of the second tube, the extension mechanism having a forward portion and an aft portion, the aft portion being located at the forward end of the tube and the forward portion being located at the aft end of the second tube.

12. The apparatus of claim 1, further comprising a closable breech door located at the aft end of the tube.

13. The apparatus of claim 1, wherein the means for igniting the propellant charges in sequence comprises an electronic ignition system configured such that propellant charges are ignited in sequence in response to an initial electronic ignition signal and following electronic ignition signals, the initial electronic ignition signal emanting from a portion of the electronic ignition system in response to a command signal from a user of the apparatus, and the following electronic ignition signals emanating from a portion of the electronic ignition system in a predetermined sequence at predetermined intervals of time.

14. The apparatus of claim 13, wherein the electronic ignition system comprises:

an electronic ignition power supply;

an electronic ignition controller; and a plurality of wires, each wire electrically connecting the electronic ignition power supply and a propellant charge.

15. The apparatus of claim 1, wherein the propulsion housing comprises:

a forward plate located at the forward end of the propulsion housing; and a nozzle having a throat, the nozzle being located at the aft end of the propulsion housing.

16. The apparatus of claim 15, further comprising a restraining member securing the nozzle to the forward plate.

17. The apparatus of claim 16, wherein the restraining member has slots placing the interior of the propulsion housing in fluid communication with at least one of the charges, such that when the propellant charges are ignited while adjacent to the propulsion housing, combustion gases from the charges flow into the interior of the propulsion housing and out the opening of the aft end.

18. The apparatus of claim 16, wherein the interior of the propulsion housing has a central longitudinal axis, further comprising a baffle attached to the restraining member, the baffle being generally planar in shape and disposed generally in a plane containing the central longitudinal axis of the housing, for directing the flow of combustion gases produced by the propellant charges.

19. The apparatus of claim 16, wherein the interior of the propulsion housing has a central longitudinal axis, further comprising a baffle attached to the restraining member, the baffle being disposed in helical fashion about the central longitudinal axis of the housing, for directing the flow of combustion gases produced by the propellant charges and imparting to the housing a spin about the central longitudinal axis.

* * * * *